United States Patent [19]

Aker

[11] Patent Number: 4,522,141

[45] Date of Patent: Jun. 11, 1985

[54] SHIPBOARD ICE LUBRICATION SYSTEM AND JET PUMP FOR USE THEREIN

[75] Inventor: Charles M. Aker, Lake Forest, Calif.

[73] Assignee: Omnithruster, Inc., Sante Fe Springs, Calif.

[21] Appl. No.: 380,522

[22] Filed: May 21, 1982

[51] Int. Cl.[3] ..... B63B 1/38

[52] U.S. Cl. ..... 114/40; 114/67 A; 417/198

[58] Field of Search ..... 114/40, 41, 42, 67 A, 114/67 R, 151; 417/194, 197, 198, 157, 171, 160; 405/60, 61; 440/44

[56] References Cited

U.S. PATENT DOCUMENTS

| | | | |
|---|---|---|---|
| 2,722,895 | 11/1955 | Porter | 417/160 |
| 2,754,791 | 7/1956 | Nieding | 114/67 A |
| 2,954,750 | 10/1960 | Crump et al. | 114/67 R |
| 3,273,333 | 8/1966 | Roulund | 440/44 |
| 3,580,204 | 5/1971 | Burmeister | 114/67 A |
| 4,029,035 | 6/1977 | German | 114/40 |
| 4,208,172 | 6/1980 | Dill | 417/171 |

FOREIGN PATENT DOCUMENTS

| | | | |
|---|---|---|---|
| 494225 | 9/1919 | France | 417/194 |
| 1500746 | 2/1978 | United Kingdom | 114/40 |
| 237604 | 2/1969 | U.S.S.R. | 114/40 |
| 510414 | 6/1976 | U.S.S.R. | 114/40 |

OTHER PUBLICATIONS

German Design Document G8028249.1, 3/81.

Water Jet Exhausters and Compressors by Schutte & Koerting Company, Bulletin No. 4-P, FIG. 482-A, Aug. 1934.

*Primary Examiner*—Trygve M. Blix

*Assistant Examiner*—Edwin L. Swinehart

*Attorney, Agent, or Firm*—Freilich, Hornbaker, Rosen & Fernandez

[57] ABSTRACT

An ice lubrication system for easing the passage of a ship through ice laden waters. A pressurized flow of water passes through a nozzle into the inlet of a mixing chamber comprising a venturi where gas from a gas manifold is mixed with the water. The effect of the venturi is to first cause the gas to mix into the water flow and, after passage of the flow through the venturi, to cause the gas to emerge from the water. A frothy combination of gas bubbles and water is thus created which is discharged through openings in the ship's hull below the waterline. Once discharged, the gas and water combination rises up the side of the hull to provide separation and lubrication betwen the hull and floating ice.

4 Claims, 11 Drawing Figures

SHIPBOARD ICE LUBRICATION SYSTEM AND JET PUMP FOR USE THEREIN

FIELD OF THE INVENTION

This invention relates generally to improvements in jet pumps and shipboard ice lubrication systems utilizing such pumps for facilitating the movement of a ship through ice laden waters.

BACKGROUND OF THE INVENTION

The presence of ice in navigable waters impedes the progress of ships therethrough because of, among other things, friction created by the hull of a ship rubbing against large pieces of ice. A variety of ice lubrication systems for reducing such friction have been proposed. For example, U.S. Pat. No. 3,665,886 describes means for discharging heated water from above the water line of the ship to melt ice proximate thereto, and U.S. Pat. Nos. 3,580,204 and 4,029,035 describe pump and pipe arrangements designed to blow compressed air or other gases through openings in a ship's hull below the waterline. The gas so discharged rises alongside the hull, creating a ridge of gas and water between the hull and the ice. Such prior art devices typically require means for compressing the gases and/or heating the water utilized by the system.

SUMMARY OF THE INVENTION

The present invention is directed to an improved ice lubrication system for a ship for facilitating its passage through ice strewn waters and to an improved jet pump suitable for use in such an ice lubrication system.

In accordance with one aspect of the present invention, an improved jet pump is provided which efficiently utilizes a liquid flow, e.g. water, to entrain a gas, e.g. air, to discharge a mixture having a relatively high gas/liquid ratio. In accordance with the invention, a vortex generating means is incorporated in the jet pump inlet nozzle to impart a swirl rotational motion to the liquid stream flowing into the jet pump suction chamber. The liquid stream, exiting at a high velocity from the inlet nozzle, lowers the pressure in the suction chamber to draw gas from a supply source coupled thereto. The rotational motion of the stream enhances the suction and facilitates the mixing of the liquid and gas.

In accordance with a different aspect of the present invention, an improved shipboard ice lubrication system is provided including means for discharging a liquid/-gas mixture through openings in the ship's hull, preferably located below the waterline, to wet the hull/fractured ice interface to reduce friction therebetween and thus facilitate movement of the ship through ice laden waters.

In a preferred embodiment of the shipboard ice lubrication system, a plurality of jet pumps are provided, each having its discharge port mounted adjacent to a different opening in the ship's hull. The jet pumps are supplied by a pressurized water source and an air source. The pressurized water source includes a liquid manifold which is supplied by a water pump drawing water from the sea.

In accordance with one feature of the preferred embodiment, the vortex generating means in each jet pump comprises a plurality of vanes oriented around the inner periphery of the inlet nozzle to rotate the liquid stream passing therethrough while permitting waterborne debris and ice to move through the nozzle's central axial region without clogging.

In accordance with a further feature of the preferred embodiment, the air is warmed prior to entering the jet pump suction ports by passing it over a heat dissipating device such as the sea water pump drive motor.

In accordance with a still further feature of the preferred embodiment, the suction chamber of each jet pump is coupled to a gas manifold having an entrance opening adjacent the ship's hull above the waterline and a valve is located between the pump's discharge port and its opening in the ship's hull whereby, when the valve is closed, the water stream exiting from the inlet nozzle will be discarged from the air tube entrance opening to facilitate snow removal from floating ice blocks.

In accordance with a still further feature of the preferred embodiment, the aforementioned ice lubrication system is associated with a directional thruster system enabling the same water pump to supply water to both systems.

DETAILED DESCRIPTION

Figure 1:
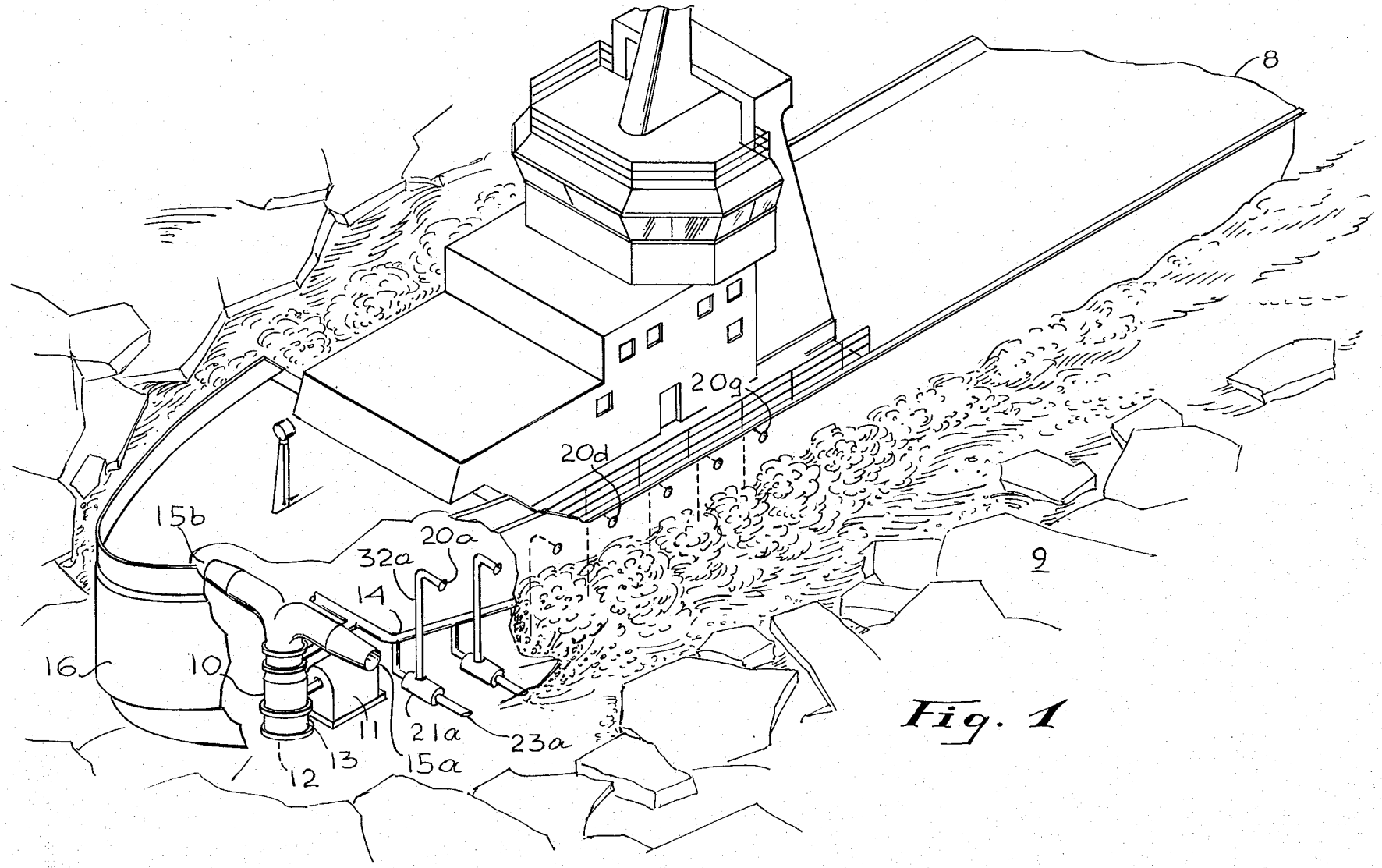
FIG. 1 is an isometric view, partially broken away, of a vessel incorporating an ice lubrication system in accordance with the invention shown in combination with a boat thruster system.

FIG. 1 depicts a ship 8 passing through a body of water wherein large pieces of ice 9 are present. As depicted, a boat thruster system for propelling and/or maneuvering the ship is mounted within the hull 16 of ship 8. In accordance with the invention, an ice lubrication system for easing the passage of the ship 8 through ice laden waters is also mounted within hull 16 and is interconnected with the thruster system in order to receive water pumped thereby. Thruster systems, as described, for example, in U.S. Pat. Nos. 4,056,073 and 4,214,544 exemplify thruster systems with which the present ice lubrication system is compatible. Since such systems are well known, they will not be explained in detail herein.

The thruster system depicted in FIG. 1 utilizes a water pump 10 driven by motor 11 to draw water from the sea through water inlet 12 and pipe 13. The water drawn in may then be discharged through thruster outlets 15*a* and/or 15*b*, supplied to the ice lubrication system via liquid manifold (or conduit) 14, or both by manipulation of a valve arrangement to be explained hereinbelow.

The preferred embodiment of the ice lubrication system utilizes pump 10 to provide a water supply to manifold 14. Manifold 14 supplies a flow of water to a plurality of jet pumps 21*a*–21*x* spaced along the port and starboard sides of the ship wherein a suitable gas (air herein), drawn through inlets 20*a*–20*x* and conduits 32*a*–32*x*, is entrained with the water flow. The air so supplied may, if desired, first be heated by passage over warm machinery, such as pump drive motor 11 or by other conventional means. The liquid/gas mixture produced by jet pumps 21*a*–21*x* is subsequently discharged to the sea through hull discharge openings 23*a*–23*x* located below the chine of the ship. Since each of the jet pumps is essentially identical, the operation of the system will now be explained in greater detail in terms of the operation of a representative jet pump 21.

Figure 2:
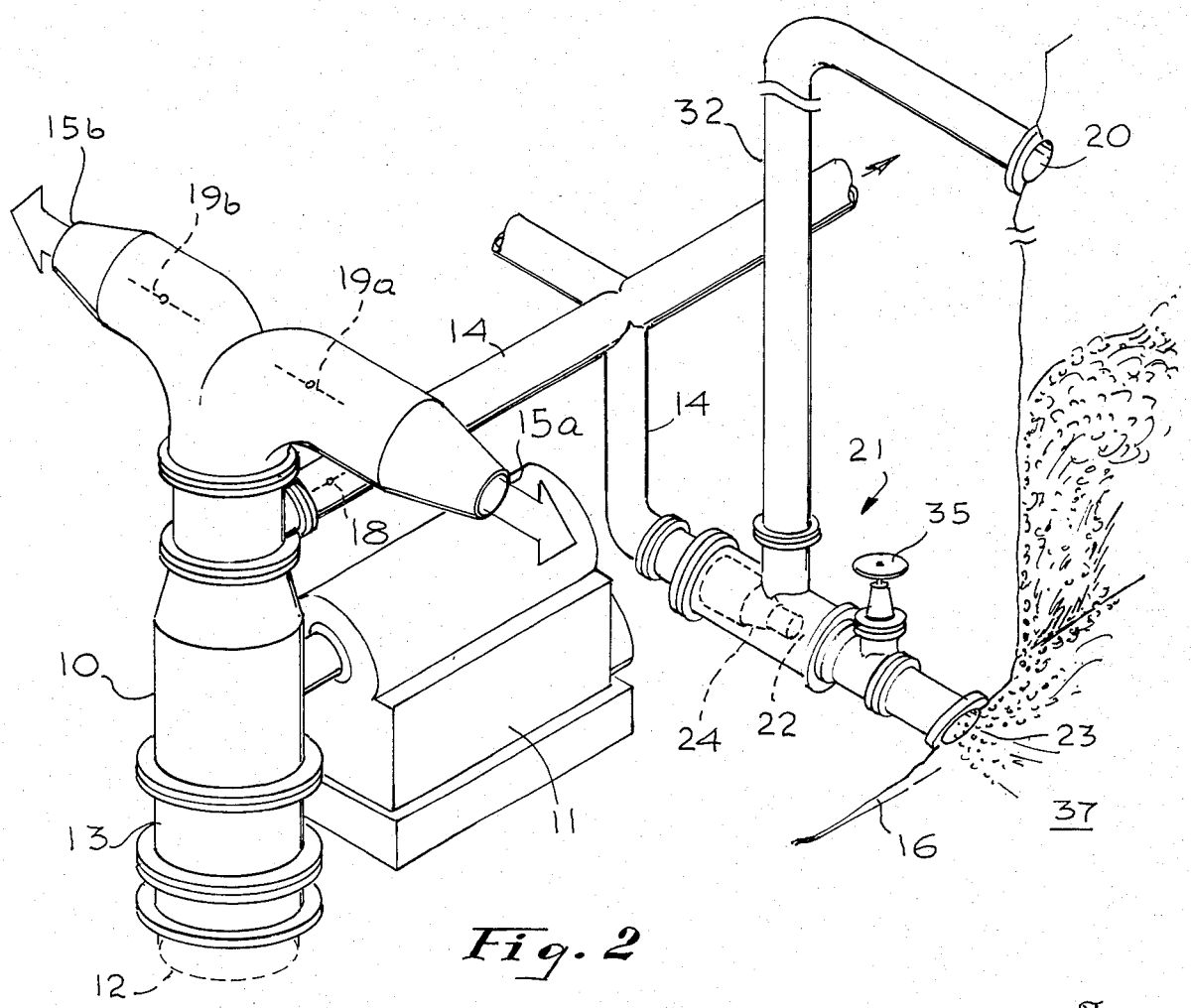
FIG. 2 is an isometric view depicting a portion of FIG. 1 in greater detail.

FIG. 2 provides a more detailed view of a representative portion of the ice lubrication system of FIG. 1. Jet pump 21, comprising suction chamber 22 and nozzle 24 receives the water flow from manifold 14. The water flow is accelerated through converging nozzle 24 and discharged into suction chamber 22 wherein air supplied through conduit 32 is entrained with the water flow. The liquid/gas mixture so produced is then discharged through hull discharge opening 23, preferably below the waterline of the ship. After discharge, the mixture rises to the water surface to lubricate the interface between the hull 16 of the ship 8 and the ice 9.

Figure 3A:
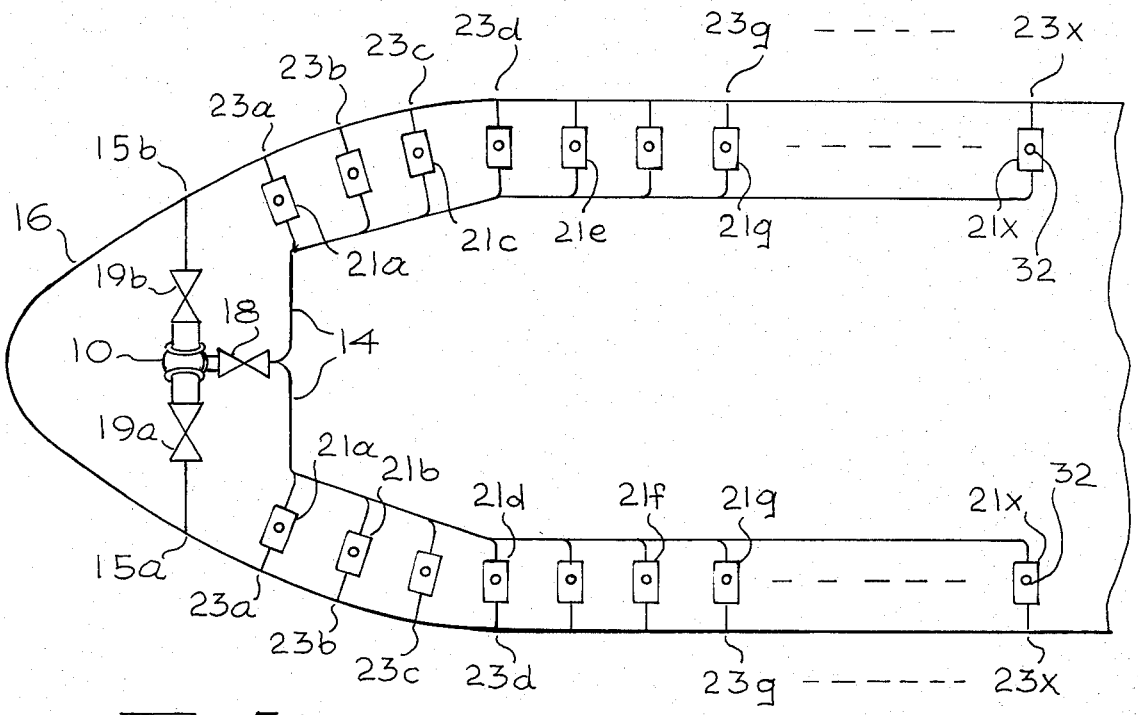
FIG. 3A is a schematic plan view of the ice lubrication system of FIG. 1 depicting the orientation of multiple hull openings.
Figure 3B:
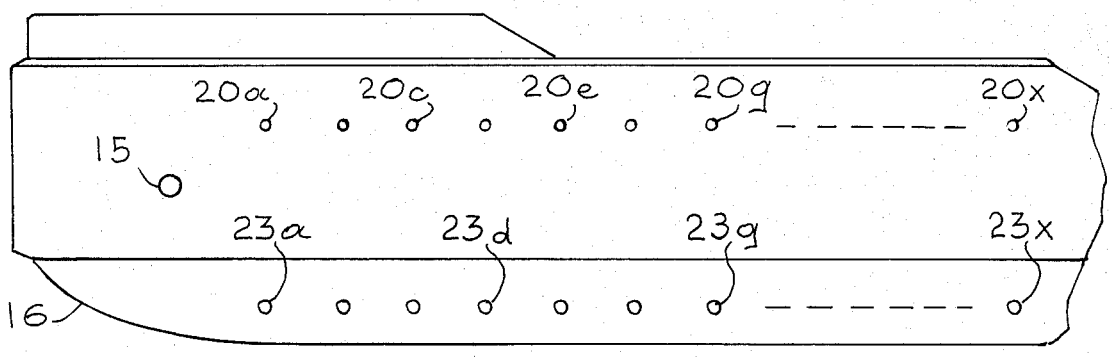
FIG. 3B is a schematic side elevation view of the hull of the ship depicted in FIG. 3A.

FIG. 3A provides a plan view of an ice lubrication system comprising a plurality of jet pumps 21*a*–21*x* and discharge openings 23*a*–23*x* dispersed along the port and starboard sides of a ship. The relative placement of air inlets 20*a*–20*x* in the preferred embodiment is shown in FIG. 3B.

The ice lubrication system of the preferred embodiment may be operated with or without simultaneous operation of the boat thruster. If the two systems are operated concurrently, the output of pump 10 is shared therebetween. The pump 10 should be selected to have sufficient capacity to provide the required water flow for simultaneous operation of both the thruster and ice lubrication systems.

Figure 4A:
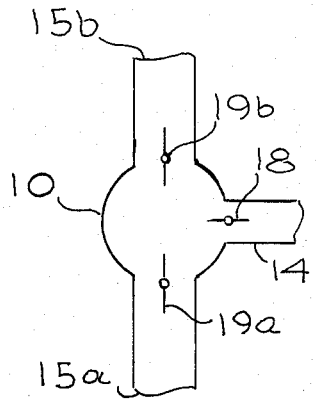
FIG. 4A is a schematic representation of the control valves of FIG. 2 configured for simultaneous thruster and ice lubrication operation.
Figure 4B:
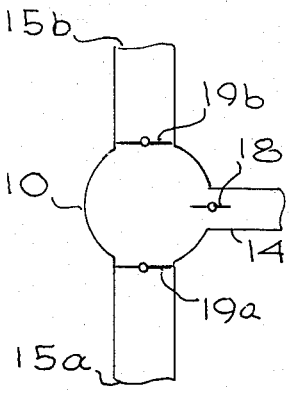
FIG. 4B is a schematic representation of the control valves of FIG. 2 configured for ice lubrication operation only.
Figure 4C:
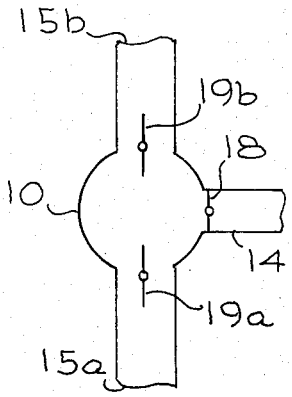
FIG. 4C is a schematic representation of the control valves of FIG. 2 configured for thruster operation only.

FIGS. 4A, 4B and 4C depict the basic thruster ice lubrication system control valve configurations wherein valve 18 controls the flow of water through conduit 14 and valves 19 and 19*b* control the flow of water through thruster outlets 15*a* and 15*b* respectively. In FIG. 4A, both the thruster and ice lubrication systems are operating and each of valves 18, 19*a* and 19*b* are open to allow water flow therepast. In FIG. 4B, the thruster system is not operating, indicated by valves 19*a* and 19*b* being closed, and the ice lubrication system is operating, indicated by valve 18 being open. Finally, FIG. 4C depicts the condition wherein the thruster system is operating, indicated by valves 19*a* and 19*b* being open and the ice lubrication system is not operating, indicated by valve 18 being closed. Of course, either of valves 19*a* or 19*b* may be opened or closed independently of the other to provide side thrust for the vessel regardless of the position of valve 18.

A typical ice lubrication system as described hereinabove could be expected to require a water flow on the order of 32,000 gallons per minute to supply 15–20 port and 15–20 starboard hull openings approximately 4 inches in diameter and spaced every six to nine feet in the forepart of the hull. The power absorbed in such a typical system could be expected to be on the order of 600 horsepower. The number of openings depends on the size of the vessel and the desired pattern for the air/water stream. Representative systems are designed to lubricate the forward one-third of a vessel's hull.

Figure 5:
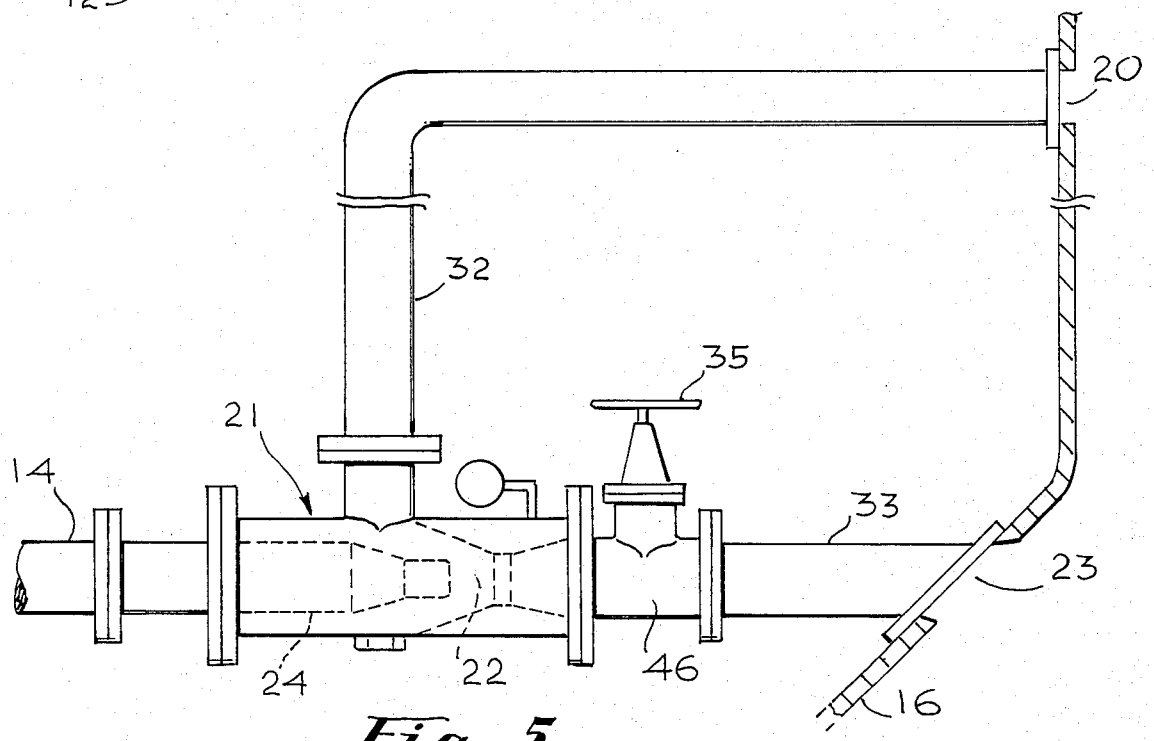
FIG. 5 is a side view of a single jet pump and related structure.

FIG. 5 depicts an embodiment of the invention wherein the discharge flow from jet pump 21 must pass through valve 46 before being discharged overboard. Valve 46 is normally open during ice lubrication system operation, but may be closed as by manipulation of valve control 35 when the system is not in use to prevent sea water from entering the system through hull discharge opening 23. Valve 46 may also be closed in order to force water flowing through jet pumps 21 to flow upward through conduit 32 and overboard through air inlet 20 in order to wash accumulated snow from the ice sheet adjacent the vessel's hull. Such washing away of the snow aids the lubrication process.

Figure 6:
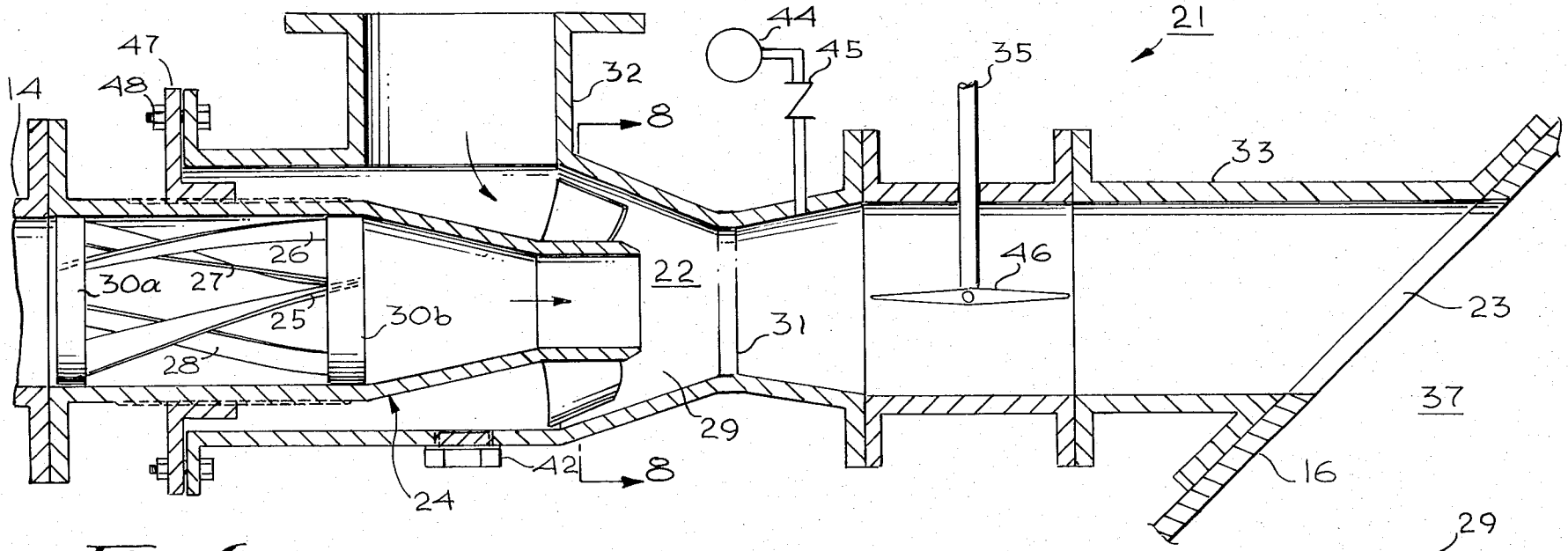
FIG. 6 is a sectional view depicting a jet pump and discharge apparatus in accordance with the invention.
Figure 8:
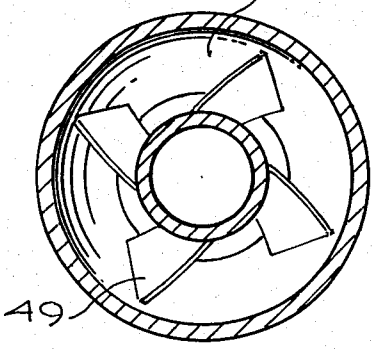
FIG. 8 is a sectional view taken substantially along the plane 8—8 of FIG. 6.

FIG. 6 illustrates an improved jet pump in accordance with the invention. The water from manifold 14 flows through nozzle 24 to suction chamber 22. A vortex generator comprising vanes 25, 26, 27 and 28 is inserted within nozzle 24 in order to impart a swirl or rotational component at the outer boundary of the water flow passing therethrough. In the preferred embodiment, such vanes define substantially planar surfaces extending from approximately the inner surface of nozzle 24 into the water flow path. The vanes are preferably twisted around their long axes and oriented so as to define an acute angle with the longitudinal axis of the nozzle. This particular vane orientation is selected to introduce a swirl component into the water column flowing through the nozzle, particularly at the outer boundary thereof. Such swirling tends to increase the aeration of the water and improve the spread pattern of the water/air mixture discharged through opening 23. As depicted in FIG. 6, the vanes project only part way into the flow path through nozzle 24 leaving a path along the central axis thereof for the unimpeded passage of debris and ice. The likelihood of nozzle 24 becoming clogged is thus reduced.

Figure 7:
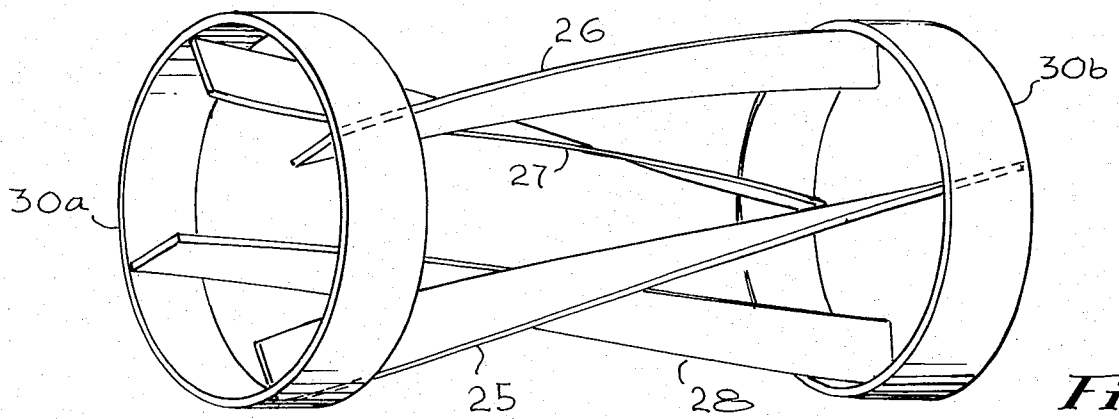
FIG. 7 is an isometric view of a vortex generating means in accordance with the invention.

The vortex generator of the preferred embodiment is depicted in FIG. 7. Vanes 25, 26, 27 and 28 comprise essentially planar members which are affixed at each end to ring housings 30*a* and 30*b*. Ring housings 30*a* and 30*b* are shaped so as to be insertable within nozzle 24 as depicted in FIG. 6. As shown in FIG. 7, the vanes are preferably twisted by a predetermined amount around their long axes to improve vortex (or swirl) generation. Undesired movement of the vanes within the nozzle is prevented by bolting, keying or otherwise securing the vortex generator to the inside surface of the nozzle.

In accordance with the Bernoulli Principle, the stream of water emanating from nozzle 24 and flowing through suction chamber inlet 29 tends to lower the pressure in the vicinity of the moving stream as air molecules in inlet 29 are carried away by the stream. Thus, air via conduit 32 is drawn into the suction chamber inlet 29 where it mixes with the water stream. The aerated water stream accelerates and the static pressure thereof decreases as it passes through jet pump throat 31 into discharge port 33 which acts as a diffuser for the air/water mixture. The discharge port 33 is connected to hull discharge opening 23 and therefore communicates with the underwater ocean environment 37. Pressure/velocity transitions taking place in the mixture stream proximate jet pump discharge port 33 are therefore taking place adjacent hull discharge opening 23. Since passage of the air/water mixture from the jet pump throat 31 into the outlet port 33 results in a reduction in the velocity of the air/water mixture flow and a concurrent increase in the static pressure thereof, the air tends to emerge from the mixture thus creating a frothy combination of water and air which emanates from the opening 23 in the hull of the ship. The mixture of water and air bubbles migrates upwardly alongside the outer surface of hull 16, thus providing the desired ice lubrication. The buoyance of the entrained air bubbles tends to accelerate the air/water mixture vertically, creating a surface effervescence or frothing action which aids in wetting and thus lubricating the interface between the hull and the ice sheet. In the preferred embodiment, the hull openings are preferably located below the chine or intersection of the sides and the bottom of the ship.

In the preferred embodiment, the outer surface of nozzle 24 is threaded so as to threadably engage flange 47. Flange 47 may be engaged with the housing of suction chamber 22 by bolts 48. Since varying the projection of nozzle 24 into suction chamber inlet 29 tends to control the degree of aeration of the water stream, nozzle 24 may be screwed into flange 47 until nozzle 24 projects the desired distance into inlet 29. The distance of such nozzle projection is determined by consideration of the air/water ratio desired in the mixture. Thus, varying the projection of nozzle 24 into the mixing chamber acts to vary the air/water ratio. The position of the nozzle is, however, typically fixed during intital installation of the system.

In order to further enhance the air/water mixing, it can be advantageous in some embodiments to also include vanes 49 upstream from the chamber 22 to impart a swirl component to the entering air stream.

Each suction chamber is provided with a drain 42 as depicted in FIG. 6. The purpose of drain 42 is to allow removal of residual water from the chamber during periods of system inactivity to prevent freeze-up. A source of compressed air 44 is also connected to suction chamber 22 via check valve 45 at the outlet 33 thereof to assist in removal of any material such as ice or other debris which may clog outlet 33 during operation.

Although a preferred embodiment has been disclosed including an ice lubrication system operating in conjuction with a boat thruster system, it should be recognized that the ice lubrication system finds independent utility and need not be used in conjunction with a thruster system. It is also pointed out that the jet pump disclosed herein, although well suited to the ice lubrication application, finds independent utility for mixing various liquids and gases.

It should also be noted that the system as described hereinabove affords sound absorption or masking tending to prevent detection of the ship; i.e. the air/water mixture has a lower sound propagation velocity than either air or water alone. Thus, operation of the ice lubrication system provides effective masking of sound produced by other pieces of machinery on the ship.

From the foregoing, it should be apparent that the present invention provides a novel and useful jet pump and ice lubrication system for ocean going ships. It is recognized that different embodiments of the invention may become obvious to those skilled in the art and the claims associated herewith are intended to include all such embodiments.

What is claimed is:

1. In combination with a ship having a hull and pump means for drawing water from the sea through an inlet in said hull, an ice lubrication system for facilitating the passage of said ship through ice laden water, said system comprising:

a first plurality of discharge openings formed in the starboard side of said hull below the chine of said ship and spaced from one another extending toward the stern from the bow portion of said hull;

a second plurality of discharge openings formed in the port side of said hull below the chine of said ship and spaced from one another extending toward the stern from the bow portion of said hull;

a plurality of jet pumps each having a water inlet, a gas inlet, and a gas/water outlet, each of said jet pumps being mounted in said hull with the gas/water outlet thereof adjacent to a different one of said discharge openings;

a gas source means including a plurality of air holes in the sides of said hull above said discharge openings and a plurality of air pipes each connecting a different one of said air holes to the gas inlet of a different one of said jet pumps; and conduit means for coupling the outlet of said pump means to said jet pump water inlets for causing each of said jet pumps to produce a gas/water mixture and discharge it through the discharge opening adjacent thereto;

each of said jet pumps comprising:

a pipe section having a throat defined between an upstream converging portion and a downstream diverging portion defining said gas/water outlet and wherein said gas inlet is proximate to said converging portion; and a nozzle means including a converging nozzle mounted substantially concentrically within said pipe section for discharging a water flow therein proximate to said pipe section converging portion for producing a suction at said gas inlet to pull gas therethrough, said nozzle means including a vortex generating means mounted upstream from said converging nozzle for creating sufficient turbulence in the outer boundary of the water flow discharged therefrom to entrain in the water flow the gas pulled through said gas inlet; and valve means associated with each of said jet pumps for selectively directing the water flow supplied thereto either to the gas/water outlet thereof or through the air pipe connected thereto for discharge through one of said air holes.

2. The combination of claim 1 further including vane means mounted within said pipe section between said gas inlet and said throat for rotating the gas stream pulled through said gas inlet around its primary direction of flow.

3. The combination of claim 1 wherein said vortex generating means comprises one or more vanes mounted on the inner periphery of said nozzle means and elongated substantially in the direction of the water flow thereat, each of said vanes defining a surface extending substantially radially inwardly from the inner periphery of said nozzle means and oriented to essentially rotate the outer portion of said water flow around the direction of flow.

4. The combination of claim 3 wherein the dimensions of said vane surfaces extending substantially radially inwardly are sufficiently small to leave an unimpeded central path for passing ice and/or debris.

* * * * *